US009416489B2

(12) United States Patent
Erlendsson

(10) Patent No.: US 9,416,489 B2
(45) Date of Patent: Aug. 16, 2016

(54) BRAIDED ROPE, SUITABLE TO BE USED AS A TOWING WARP, COMPRISING CHANGING PROPERTIES IN THE LENGTH DIRECTION THEREOF

(75) Inventor: Hjortur Erlendsson, Kopavogur (IS)

(73) Assignee: Hampidjan hf, Reykjavik (IS)

( * ) Notice: Subject to any disclaimer, the term of this patent is extended or adjusted under 35 U.S.C. 154(b) by 460 days.

(21) Appl. No.: 13/983,565

(22) PCT Filed: Feb. 6, 2012

(86) PCT No.: PCT/IS2012/050002

§ 371 (c)(1),
(2), (4) Date: Oct. 22, 2013

(87) PCT Pub. No.: WO2012/107939

PCT Pub. Date: Aug. 16, 2012

(65) Prior Publication Data

US 2014/0033906 A1 Feb. 6, 2014

Related U.S. Application Data

(60) Provisional application No. 61/462,708, filed on Feb. 7, 2011.

(51) Int. Cl.
*D07B 5/00* (2006.01)
*D04C 1/12* (2006.01)

(52) U.S. Cl.
CPC .. *D07B 5/00* (2013.01); *D04C 1/12* (2013.01); *D07B 5/005* (2013.01); *D07B 2201/1096* (2013.01)

(58) Field of Classification Search
CPC ..... D07B 5/00; D07B 5/005; D04C 1/12
See application file for complete search history.

(56) References Cited

U.S. PATENT DOCUMENTS 2,354,212 A 7/1944 Jeckel
2,388,693 A 11/1945 Jeckel
(Continued)

FOREIGN PATENT DOCUMENTS

WO WO 2004/020732 3/2004
WO WO 2009/142766 11/2009

*Primary Examiner* — Shaun R Hurley
(74) *Attorney, Agent, or Firm* — Donald E. Schreiber

(57) ABSTRACT

Disclosed is a tow warp construction and a process for forming such tow warp construction where such tow warp construction has a longer life span, that is retains its useful dimensions and characteristics longer than known tow warp constructions and consequently has a longer useful life span than known tow warp constructions. Most broadly the construction of the tow warp construction of the present disclosure and process for forming such includes gradually and progressively introducing fibers from a second group of fibers (or "second group of linear elements") into an otherwise conventional stranding process where fibers from a first group of fibers (or "first group of linear elements") are being stranded to form strands (or "third group of linear elements"), so as to either or both increase the diameter of the strands and/or substitute the first group of fibers by fibers from the second group of fibers, so as to: a) in the first instance, increase the diameter of the formed strands and subsequently of a strength member formed of the strands, especially for increasing the diameter and strength of the tow warp's strength member in and about the splice braid zone where it connects to a towed object such as a paravane; and b) in the second instance, substitute in a predetermined region on the long dimension of the strands and subsequently in a predetermined region on a long dimension of a strength member formed of the strands fibers of higher creep and/or lower melting points by fibers of lower creep and/or higher melting points, especially for increasing the resistance of the tow warps strength member to bending fatigue.

21 Claims, 3 Drawing Sheets

(56) References Cited

U.S. PATENT DOCUMENTS

| | | | | |
|---|---|---|---|---|
| 2,494,389 | A | 1/1950 | Jeckel | |
| 3,841,015 | A | 10/1974 | Gregory | |
| 3,856,240 | A | 12/1974 | Forbis | |
| 4,184,784 | A | 1/1980 | Killian | |
| 5,901,632 | A * | 5/1999 | Ryan | B65H 69/06 57/22 |
| 5,931,076 | A * | 8/1999 | Ryan | B65H 69/06 87/13 |
| 2005/0229770 | A1 * | 10/2005 | Smeets et al. | D04C 1/12 87/8 |

* cited by examiner

BRAIDED ROPE, SUITABLE TO BE USED AS A TOWING WARP, COMPRISING CHANGING PROPERTIES IN THE LENGTH DIRECTION THEREOF

This patent application claims the benefit of U.S. Provisional Patent Application No. 61/462,708 entitled "Long Lived Tow Warp" that was filed with the United States Patent and Trademark Office on Feb. 7, 2011, and from which Patent Cooperation Treaty International Application Number PCT/IS2012/050002, that was filed with the Icelandic Patent Office on 6 Feb. 2012, claims priority.

TECHNICAL FIELD

The present disclosure relates generally to the technical field of ropes and cables, more particularly to ropes and cables used to tow upon paravanes, including trawl doors and diverters, especially in conducting studies and surveys of a marine seabed such as in the field of marine seismology as well as in trawl fishing.

BACKGROUND ART

The use of towing warps in trawling and marine seismology is well known. In trawling the towing warp is generally referred to as a "warp" or "tow warp". In marine seismology the towing warp is generally referred to as a "superwide cable" (also known as "wide tow ropes", "superwides" and "main tow ropes"), the term "rope" and the term "cable" to be interchangeable for purposes of the present disclosure.

In trawl fishing, a trawler deploys a tow warp to tow upon a trawl system including a trawl net and often paravanes known as "trawl doors". A main problem in trawl fishing is that a heavy weight of steel wire cable for use as tow warps makes trawling vessels unstable and dangerous, having been responsible for many capsizes and losses of life. Other problems with steel wire include premature failure from oxidation and electrolytic degradation. In order to resolve these problems associated with steel wire tow warps, many trawling vessels are using towing warps formed of synthetic fibers. However, a main problem with such synthetic fiber formed towing warps is that they tend to prematurely break both in the area proximal (including "at") a sheave (including "block") upon which the towing warps bend and rest, as well as proximal the connection point to a paravane. The same problem exists with the deployment of synthetic towing warps in marine seismology.

Furthermore, in marine seismology at sea, a seismic ship deploys a streamer or cable behind the ship as the ship moves forward. Multiple receivers are typically towed behind the ship on streamers in an array. Streamers typically include a plurality of receivers. A seismic source is also towed behind the ship, with both the source and receivers typically deployed below the surface of the ocean. Streamers typically include electrical or fiber-optic cabling for interconnecting receivers and seismic equipment on the ship.

Streamers are usually constructed in sections 25 to 100 meters in length and include groups of up to thirty-five or more ideally uniformly spaced receivers. The streamers may be several miles long, and often a seismic ship trails multiple streamers, with ideally a uniform lateral separation between the streamers, to increase the amount of seismic data collected. Operating at a typical production speed of 4 to 5 knots and towing in excess of 50 tons of instrument-laden equipment in the water, a great deal of drag induced tension is generated. Similarly, the number and length of streamers to be deployed, as well as the lateral separation to be maintained between streamers, dictates the size of diverters, or paravanes, that must be deployed with the array, and also has a major impact on the tension that ultimately is transferred to a seismic ship through the superwides.

The amount of equipment towed behind a ship is generally dictated by the requirements of the job. The equipment and cables being towed create a drag on the ship. The more equipment and cables that are towed behind a ship, the more drag is created, thus the more lateral spreading force is required to achieve desired separations between cables, and the more tension is transferred to the seismic ship through the superwides. This results undesirably in high stresses in the superwides, that ultimately lead to premature failure of the superwides at a region of the connection of the superwides to the diverters. The premature failure of the superwide cables in this one region results in substantial technical complications and financial losses as either the superwide cables must be premature replaced, i.e. before the normal safe working life span of the majority of the superwide cable is reached, or breakage occurs resulting in large equipment failures and operational losses.

Attempts at strengthening a rope or cable in the vicinity of its connection to an object, such as disclosed in U.S. Pat. No. 4,184,784, have failed to solve the problem and have not been accepted by the industry. These attempts mainly include incorporation into and between strands of an already formed rope of other strands formed of a plurality of fibers. The incorporation of the other strands is accomplished by opening up the braid structure of a rope and inserting into and between the strands forming the already formed rope the other strands so as to accomplish a tapered transition from the undisturbed portion of the already formed rope to the portion into which the other strands are being incorporated and generate a strengthened and enlarged portion to the rope. In such known teachings, the strands being incorporated into the rope are either braided or twisted strands where the strands include at least one hundred fibers and there is no knotting, due to the fact that knotting of the Inserted other strands to those strands already present in the already formed portion of the rope is known to cause rapid destruction of the rope, thus the use of knotting in such applications being contrary to the trend of the industry, against the state of the art and against the belief of those in the industry. As mentioned supra, such constructions and methods for ropes with an increased diameter and breaking strength in a certain region have failed to be accepted into the industry.

Furthermore, attempts at altering the material composition of the rope by this method, especially by splicing into a rope formed of a super fiber material such as UHMWPE (e.g. "Dyneema®") another rope formed of an elastic material such as Polyamide (e.g. "Nylon"), have proved to be unreliable, with failure of the rope at the splice junction being the norm, and have thus been rejected by the industry.

Thus, it is readily apparent that both the tapering of ropes used for towing warps as well as the alteration of ropes used for towing warps from one material to another material is contrary to the trend in the industry and against the state of the art in the industry.

Both in trawl fishing as well as in marine seismology an accepted principle is that steel wire is more tolerant of bending fatigue than are synthetic cables formed of UHMWPE due to the fact that the steel wire is more elastic than is the cable formed of UHMWPE, it being accepted in the industry that a more elastic cable is more able to tolerate bending forces leading to bending fatigue induced failure than is a less elastic cable. Similarly, it is accepted in the industry that a more elastic material is better able to tolerate bending forces leading to bending fatigue induced failure than is a less elastic material, and that therefore a cable such as a tow warp formed of a more elastic construction is better able to tolerate bending and is more resistant to bending fatigue induced failure than is a tow warp formed of a less elastic material.

Thus, due for one to the greater failure rate of synthetic tow warps vs. steel wire tow warps in the area proximal a sheave and/or other block from which depends a tow warp, despite the much increased dangers of recoil induced fatality and crippling of workers, vessel capsize as well as economic disadvantages associated with reduced hold capacity resultant of displacement needs caused by steel wire tow warps, many trawl fishing entities as well as entities conducing marine seismology continue to use steel wire tow warps rather than synthetic tow warps, including synthetic tow warps formed of super fibers such as fibers formed of UHMWPE.

Thus, it can readily be appreciated that a long felt need exists in the industry for a tow warp construction that retains its useful dimensions for a greater period of time than known tow warp constructions in and about the region of its location to a sheave and/or other block that is used in deployment of the tow warp.

Thus, also it can readily be appreciated that a long felt need exists in the industry for a tow warp construction where such tow warp construction retains its useful dimensions in and about the region of its location to a paravane for a greater period of time than known tow warp constructions and where such tow warp construction is lighter in weight than steel both in air as well as in water and preferably is made of a material that is less elastic and has less ability to store kinetic energy and thus to recoil than does steel wire.

Thus also, it can readily be appreciated that a long felt need exists in the industry for a tow warp construction that retains its useful dimensions for a period of time that is similar to and preferably at least as great as the expected safe working life span of that portion of a tow warp that is not normally experiencing premature failure as a result of its proximity to a paravane.

Thus also, it can readily be appreciated that a long felt need exists in the industry for a tow warp construction where such tow warp construction retains its useful dimensions in and about the region of its location to a paravane for a greater period of time than known tow warp constructions where such period of time is sufficient to permit full use of the expected safe working life span of the majority of the tow warp construction without unduly risking premature failure of the tow warp in the region of its connection to a paravane and without unduly risking resultant substantial technical complications and financial losses as a result of such premature failure.

Thus also it can readily be appreciated that a long felt need exists in the industry for a tow warp construction having any of: at least one strength member; an optical conductor; an electrical conductor; a sensor; and any other instrument where such tow warp construction retains its useful dimensions longer than known tow warp constructions thereby permitting less frequent replacement of the tow warp, and ideally permitting full use of the cables full life expectancy.

In addition to trawlers and seismic ships, other marine vessels, such as oceanographic ships and commercial tug boats and pilot boats also may tow cabling or equipment for which a longer lived tow warp would be beneficial. Furthermore, a synthetic rope constructed according to the present disclosure is useful also for deep water oil rig mooring lines and other deep water mooring lines.

DISCLOSURE

It is an object of the present disclosure to provide for a tow warp construction where such tow warp construction retains its useful dimensions and characteristics for a greater period of time than known tow warp constructions.

It is another object of the present disclosure is to provide for a tow warp construction where such tow warp construction retains its useful dimensions and characteristics for a period of time that is similar to and preferably at least as great as the expected safe working life span of that portion of a tow warp that is not normally experiencing premature failure as a result of its proximity to a paravane.

It is yet another object of the present disclosure to provide for a tow warp construction that retains its useful characteristics for a greater period of time than known tow warp constructions and thus has a longer useful life span than known tow warp constructions.

It is yet another object of the present disclosure to provide for a tow warp construction where such tow warp construction retains its useful dimensions and characteristics in and about the region of its region to a paravane for a greater period of time than known tow warp constructions where such period of time is sufficient to permit full use of the expected safe working life span of the majority of the tow warp construction without unduly risking premature failure of the tow warp in the region of its connection to a paravane and without unduly risking resultant substantial technical complications and financial losses as a result of such premature failure.

It is yet another object of the present disclosure to provide for a tow warp construction where such tow warp construction retains its useful dimensions and characteristics in and about the region of its location to a sheave for a greater period of time than known tow warp constructions where such period of time is sufficient to permit full use of the expected safe working life span of the majority of the tow warp construction without unduly risking premature failure of the tow warp in the region of its proximity to a sheave and without unduly risking resultant substantial technical complications and financial losses as a result of such premature failure.

It is yet another object of the present disclosure to provide for a tow warp construction having any of: at least one strength member; an optical conductor; an electrical conductor; a sensor; and any other instrument where such tow warp construction retains its useful dimensions longer than known tow warp constructions thereby permitting less frequent replacement of the tow warp, and ideally permitting full use of the cables full life expectancy.

It is yet another object of the present disclosure to provide for deep water mooring lines having more reliable connection points in the area where different substances are used to mainly form portion of the deep water mooring line that are located on either side of a connection in the deep water mooring line where such connection forms the joint between different portions of the deep water mooring line and where such portions mainly are formed of fibers formed of differing substances, especially substances exhibiting different elasticity values.

Disclosed is a tow warp construction and a process for forming such tow warp construction where such tow warp construction has a longer life span, that is retains its useful dimensions and characteristics longer than known tow warp constructions and consequently has a longer useful life span than known tow warp constructions. Most broadly the construction of the tow warp construction of the present disclosure and process for forming such includes gradually and progressively introducing fibers from a second group of fibers (or "second group of linear elements") into an otherwise conventional stranding process where fibers from a first group of fibers (or "first group of linear elements") are being stranded to form strands (or "third group of linear elements"), so as to either or both increase the diameter of the strands and/or substitute the first group of fibers by fibers from the second group of fibers, so as to:

a) in the first instance, increase the diameter of the formed strands and subsequently of a strength member formed of the strands, especially for increasing the diameter and strength of the tow warp's strength member in and about the splice braid zone where it connects to a towed object such as a diverter and/or paravane; and b) in the second instance, substitute in a predetermined region on the long dimension of the strands and subsequently in a predetermined region on a long dimension of a strength member formed of the strands fibers of higher creep and/or lower melting points by fibers of lower creep and/or higher melting points, especially for increasing the resistance to bending fatigue and to heat fatigue of the tow warp's strength member.

In the method and product of the present disclosure the fibers may be replaced by similarly dimensioned linear elements as one of ordinary skill in the art is able to understand upon having read the teachings of the present disclosure.

Possessing the preceding advantages, the methods, processes and constructions of the tow warp of the present disclosure answers needs long felt in the industry.

These and other features, objects and advantages are likely to be understood or apparent to those of ordinary skill in the art from the following detailed description of the preferred embodiment.

BEST MODE FOR CARRYING OUT THE DISCLOSURE

Figure 1:
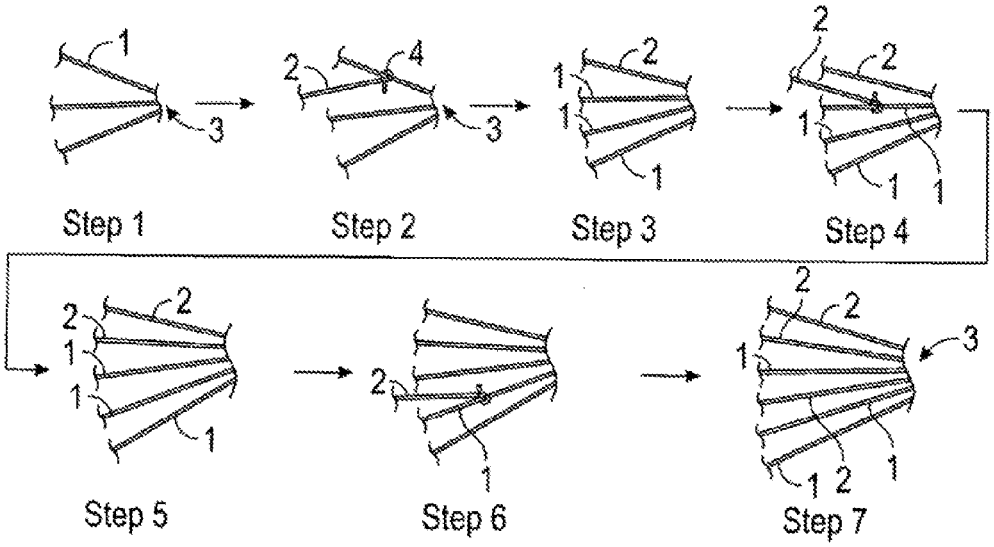
FIG. 1 is step by step illustration of a preferred method of the present disclosure showing how linear elements from a first group of linear elements are progressively augmented by linear elements from a second group of linear elements so as to double (or otherwise increase) the quantity of linear elements forming a strand of the present disclosure that may then be used to form a strength member of the present disclosure having an increased diameter in at least one predetermined region and possibly in several predetermined regions and as additionally may be combined with the teachings of FIG. 2 so as to arrive at a most preferred strength member for a tow warp of the present disclosure.

The present disclosure is based upon the surprising and unexpected discovery that fibers may be economically gradually introduced into a stranding process without compromising the integrity of produced strands and subsequent strength members formed of such strands by hand knitting, including hand knotting, or by otherwise connecting to fibers already entering a strand point in a conventional stranding process fibers from a second group of fibers, such as preferably are fibers loaded onto a second group of tube spools that are not already being used in the already in-progress stranding process. Furthermore, surprisingly and unexpectedly and contrary to the state of the art and against the trend of the industry that is to retain as uniform the quantity and type of fibers entering a stranding process and to use strands formed of such process for strength members, and against the commonly held belief of the industry which believes that to alter the fibers along the long dimension of a strength member results in premature failure of the strength member, especially when such strength member includes highly inelastic fibers such as fibers having less than four percent elasticity combined with fibers having greater than ten percent elasticity, it has been found that strands formed of the process of the present disclosure are able to be used to form strength members of the present disclosure both without compromising the strength of the strands and strength members of the present disclosure, but concurrently while actually increasing the strength, longevity, reliability, and resistance to bending fatigue of strength members of the present disclosure and formed by processes of the present disclosure even when the process of the present disclosure is used to form strength members that include at least one portion of the strength member mainly formed of fibers formed of a different substance compared to fibers mainly forming at least an immediately adjacent portion of the strength member.

Furthermore, surprisingly, unexpectedly and contrary to the state of the art and against the trend of the industry that is to employ for a tow warp a cable construction having about seven percent elasticity such as is found in steel wire cables when it is desired that the cable construction have maximal bending fatigue resistance, it has been unexpectedly discovered that by forming a portion of a synthetic tow warp with an elasticity that is lesser than two and eight tenths percent and concurrently forming a majority of the same tow warp with an elasticity that is greater than two and eight tenths percent and subsequently using the lesser elasticity portion of the tow warp for a portion of the tow warp that contacts a block with which the tow warp is used, including from which the tow warp depends, that the bending fatigue of the tow warp is actually bettered, and not reduced.

In order to form strength members of the present disclosure, first are formed strands of the present disclosure having specific properties and characteristics at regions corresponding to predetermined portions along the long dimension of strands formed of the present disclosure. Then, using conventional machinery for forming braided ropes, the strands are used to form strength members of the present disclosure having specific properties and characteristics at regions corresponding to predetermined portions along the long dimension of strength members of the present disclosure. By loading spools containing certain lengths of the formed strands into the braiding machinery apparatus, and by predetermining the amount of length of strands prior to and after any particular desired region to be formed by methods of the present disclosure, ropes of the present disclosure having regions formed according to the specific teachings of the present disclosure are able to be formed. The specific properties and characteristics include diameter dimension and material types forming filaments mainly forming the strength member where such material types are selected for having more or less of creep, more or less of elasticity, resistance to heat, and other.

Thus, it can be appreciated that the main step in forming a strength member of the present disclosure is forming strands of the present disclosure, and then using such strands formed of the present disclosure to form a strength member of the present disclosure.

Figure 1A:
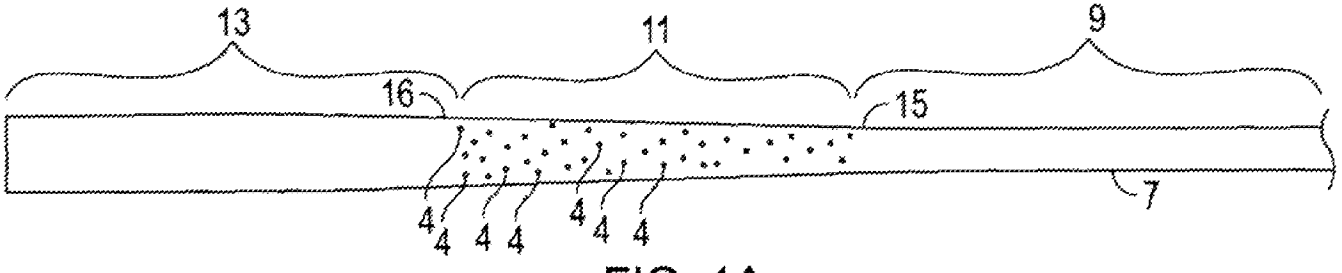
FIG. 1A is a cross sectional view taken along the long dimension of an embodiment of a strand of the present disclosure, especially as is able to be manufactured according to teachings of FIG. 1.

Diameter Enlargement Embodiments:

FIG. 1 shows a preferred embodiment for forming strands 7 (see FIG. 1A) of the present disclosure having an increased fiber count at at least one predetermined region along the long dimension of the strands formed of the present disclosure. As described in a step by step fashion:

Step One: a quantity of fibers of a first group of fibers 1 is used to form a strand using an otherwise conventional stranding process and conventional stranding equipment. For example, a jig having two hundred seventy spindles may be formed, wherein an average of forty-five to ninety spindles are each loaded with a tube bobbin, each tube bobbin itself loaded with a selected type of linear element, such as a fiber from the first group of fibers. These fibers may be replaced by yarns or even strands, all of which are known herein as "linear elements of a first group of linear elements";

Step Two: while the stranding process is occurring, at least some fibers from a second group of fibers 2 are hand knit or otherwise knotted, or otherwise connected to at least some fibers from the first group of fibers with a connection 4. The connection 4 preferably is a knot, that is contrary to the state of the art and against the trend in the industry. Preferably, one fiber from the second group of fibers 2 is connected to one fiber from the first group of fibers 1, until such time as the connection 4 is downstream of the stranding point 3, as indicated in Step Three. These fibers may be replaced by yarns or even strands, all of which are known herein as "linear elements of a second group of linear elements". Each of the linear elements from the second group of linear elements are each preferably taken from a distinctive tube bobbin that is loaded on a distinctive spindle on the jig, where the quantity of tube bobbins corresponds to the quantity of distinct second linear elements desired to be introduced into the stranding process; then Step Four to Step Five: the steps of step two to step three are repeated, and likewise for Step six to Step seven, until the quantity of fibers being used in the stranding process and forming the strand is increased as desired, for example doubled. This quantity may be increased by less than double, or by more than double, however as desired. The average distance between consecutive connections 4 may be approximately twenty centimeters.

As a result, a strand 7 of the present disclosure is formed (see FIG. 1A) having working load diameter portion 9, tapered diameter portion 11 and enlarged diameter portion 13. The tapered diameter portion contains a plurality of connections 4 each of which are the connection of a linear element of the first group of linear elements with a linear element of the second group of linear elements.

Figure 4:
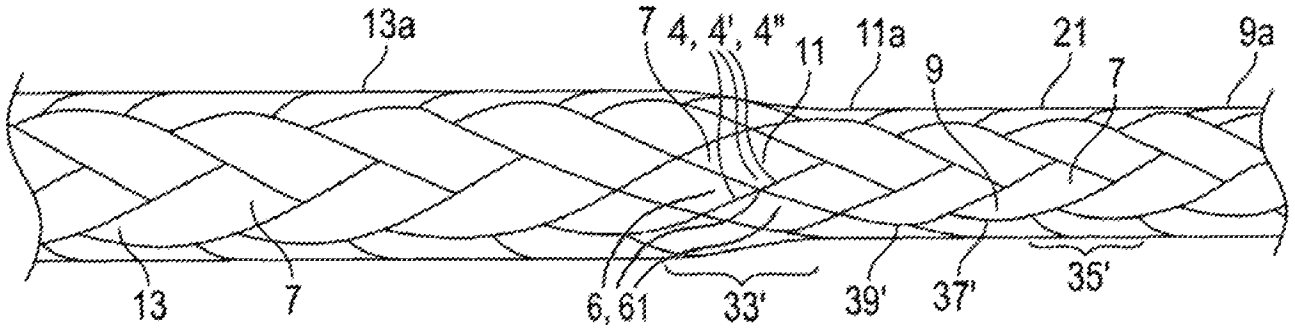
FIG. 4 is a plan view of an embodiment of a strength member of the present disclosure.

Subsequently, as shown in FIG. 4, the strands are used to form a preferred embodiment of a strength member 21 of the present disclosure using known methods for forming strength members from strands where such known methods are altered only in the synchronization of the various portions 9, 11 and 13 of the strands in forming a corresponding strength member of such strands. Strands of the present disclosure also are known herein as "third linear elements". The preferred construction for a strength member of the present disclosure is a braided strength member formed of, for example, at least eight, and more preferably at least twelve of the present disclosure's strands 7 and/or 76 and/or 72 and up to at least two thousand of such strands, and thus the preferred construction for combining the strands 7 and/or 76 and/or 72 is a braided construction. For this purpose a conventional braiding machine is used, with an addition to the conventional braiding process that the strands 7 are loaded onto tube bobbins in such a fashion that either the enlarged diameter portion's distal end or the working load diameter portion's distal end are first attached to the tube bobbin and then the remainder of a strand 7 is wound upon such tube bobbin. Several tube bobbins are thus loaded, each with a distinct strand 7 of the present disclosure, where, preferably, all the strands 7 are similarly (including "identically") configured. That is, the length of each of the distinct strands 7, the region of the tapered portion of each of the distinct strands 7 and the region of the enlarged diameter portion of each of the distinct strands 7, when any such region is measured from any distal end of any of such strand 7, is preferably identical. That way, the formation and subsequent construction of the present disclosure's strength member 21 may be coordinated so that upstream ends 15 of the tapered diameter portions of each of the distinctive strands 7 enter into the braiding point at the same time and downstream ends 16 of the tapered diameter portions of each of the distinctive strands 7 exit the braiding point at the same time, resulting in a strength member 21 of the present disclosure having a smooth transition from its strength member working load diameter portion 9*a*, throughout its strength member tapered diameter portion 11*a* to and throughout its strength member enlarged diameter portion 13*a*.

Other strands of the present disclosure, such as strands 76 and 72 (see FIG. 2A and FIG. 3) may be combined in order to form alternative strength members of the present disclosure by using the teachings taught herein for combining strands 7 of the present disclosure in order to form strength member 21 of the present disclosure. For example, when strands 72 of the present disclosure having second material portion 35 are used to form a strength member of the present disclosure, than the strength member of the present disclosure is similar to that strength member 21 of the present disclosure except that it also includes second material portion 35' as indicated in FIG. 4, where this second material portion is used to form a portion of a strength member of the present disclosure that is a portion of the strength member of the present disclosure capable of being deployed in contact with a block (including sheave) during use of the strength member for a period of time exceeding one half hour and possibly but not necessarily up to several years while concurrently increasing the life expectancy of that portion of the strength member of the present disclosure capable of being deployed in contact with a block (including sheave). Preferably, but not necessarily, several such second material portions 35' are included in any particular strength member of the present disclosure intended for use as a towing warp and especially as a trawling towing warp.

Preferably, the linear elements mainly forming the strength member second material portion 35' (and also forming the strand second material portion 35), such as fibers, mainly are selected from fibers having an elasticity of lesser than two and eight tenths percent, and/or preferably are selected from fibers having either or both an elasticity value and/or a creep value that is lesser than an elasticity value and/or a creep value of fibers mainly forming the working load portion of the strands and strength members of the present disclosure.

The enlarged strength member diameter portion 13*a* preferably is used in the formation of a splice braid zone for the tow warp of the present disclosure, especially a splice braid zone for forming a spliced eye for connection of the tow warp of the present disclosure to a towed object, such as a paravane, but also may be used to form the splice zone of a deep water mooring line or of at least a portion of a mooring line, and also is useful for forming the splice zone of a yachting line, rigging line, headline cable sonar, lead in line, seismic line (including lines containing conductors), anchor line or other line.

Using strands formed of the process of the present disclosure as taught in reference to FIG. 1 to form strength members of the present disclosure results in strength members having at least one region along their long dimension of increased diameter and strength, including increased longevity and abrasion resistance.

Mainly, the at least one increased diameter region of strength members of the present disclosure is located at a region at a terminal end along the long dimension of the strength member of the present disclosure, for example the last twenty meters of a strength member of the present disclosure. This region corresponds to an intended splice braid zone, such as where the strength member of the present disclosure would be connected to a paravane or other towed object, or even moored object if the strength member of the present disclosure is to be used for a mooring line, anchoring line, rigging line or the like.

Figure 2:
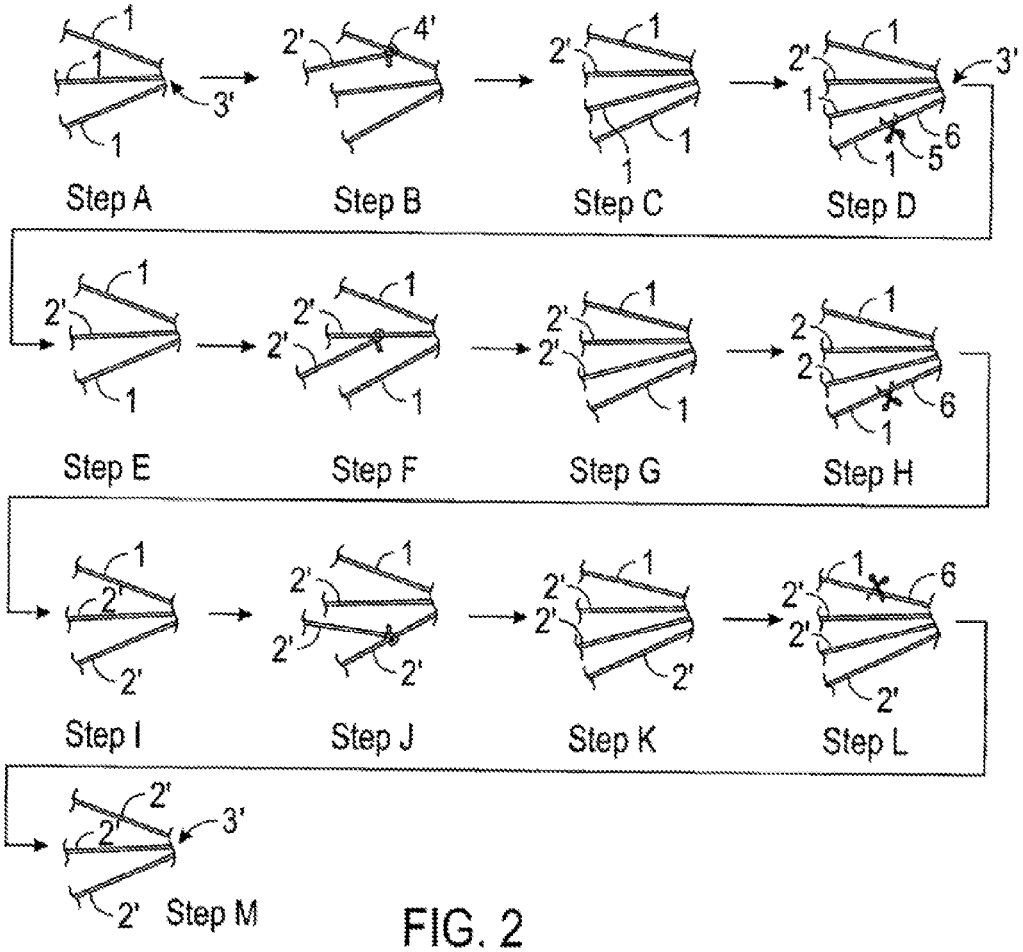
FIG. 2 is a step by step illustration of another embodiment of the preferred method of the present disclosure showing how linear elements from a first group of linear elements are progressively replaced by linear elements from a second group of linear elements so as to change along the long dimension of at least one strand of the present disclosure and by repeated the process of several strands of the present disclosure the material forming linear elements forming strands of the present disclosure as may be used to form the strength member for a tow warp of the present disclosure having regions on its long dimension formed of differing materials having differing properties.

Linear Element Replacement Embodiments:

In reference to FIG. 2: Often it is desired to alter or change the type of material used in forming fibers forming strands forming strength members of the present disclosure. As mentioned above, this is when for example it is desired to form a specific portion of a strength member of the present disclosure having greater bending fatigue resistance and/or greater cut resistance and/or greater heat fatigue resistance and/or greater resistance to creep than the majority of the strength member of the present disclosure. Generally, but not necessarily, these portions of the strength member of the present disclosure are formed at a region along the long dimension of the strength member of the present disclosure where it is intended that such strength member would be proximal (including "at" or "on") a winch, block or other sheave. For a tow warp, for example, a strength member of the present disclosure may, but not necessarily does, include several such regions situated at different portions of its long dimension that correspond to different "marks" where the vessel operator halts, in the region of a sheave or winch, pay-out or take-up deployment of the tow warp during towing operations. It is a commonly held belief in the industry that a portion of any towing warp or other line that is used on and/or proximal a sheave and/or block should have a maximal elasticity in order to best tolerate the rather high shocks that are imparted to such portion of such lines due to vibration waves travelling along other portions of such lines that are then unable to pass through the blocks and/or sheaves and thus terminate in the line in the vicinity of the sheaves and/or blocks in damaging shocks. However, contrary to the state of the art, and against the trend in the industry and against the commonly held belief of those in the industry, strength members of the present disclosure having regions situated at different portions of their long dimension that correspond to regions of the strength members of the present disclosure that are regions capable of being in contact with or proximal to a sheave and/or block and/or winch, such as for example but not necessarily during towing of a seismic array or trawl system or other deployment of the tow warp or other rope of the present disclosure (the term "rope" and the term "line" being interchangeable for purposes of the present disclosure), and where such regions are formed at least mainly of fibers exhibiting lesser elasticity compared to fibers mainly forming the majority of the strength members, and preferably where such regions are formed of fibers exhibiting lesser than two point eight tenths of a percent elasticity, have been found to exhibit superior and bettered resistance to fatigue and have been found to improve and better the longevity of such strength members, thus reducing economic losses due to accidental rupture of such strength members and due to premature replacement of such strength members in order to preclude such accidental rupture induced economic losses, thus accomplishing objects of the present disclosure.

As shown in reference to FIG. 2, in order to accomplish such objects of the present disclosure, first an otherwise conventional stranding process is enacted using fibers from a first group of fibers 1, as indicated in Step A; then Step B and Step C: fibers from a second group of fibers 2' are introduced into the stranding process as taught for Step Two and Step Three in FIG. 1; then Step D: after any connection point 4' of the introduced fibers from the second group of fibers have passed the stranding point 3', at least one fiber from the first group of fibers is severed such as by scissors 5 and thus removed from the stranding process, forming severed fiber ends 6 (including "severed linear element ends 61) resulting in a quantity of the fibers from the first group of fibers entering the stranding point 3' having been replaced either by:

a) a similar (including "same") quantity of fibers from the second group of fibers, as indicated by Step E; or b) a quantity of fibers from the second group of fibers that provide for a breaking strength that is similar to (including "same") as a breaking strength provided by the quantity of fibers from the first group of fibers that are removed; then Step F to Step I repeat Steps B to E; and Step J to Step M again repeat Steps F to Step I, until as indicated in Step M mainly (including "only") fibers from the second group of fibers are forming the strand.

The fibers of the second group of fibers are often selected to have a lower creep and to be located along the long dimension of the strands so that the resultant strength member mainly is formed of such low creep fibers at a predetermined region intended to correspond to a region where the strength member is proximal a winch or sheave, such low creep fibers being fibers having lesser creep, and preferably also lesser elasticity, than fibers forming the majority of the strength member.

Figure 2A:
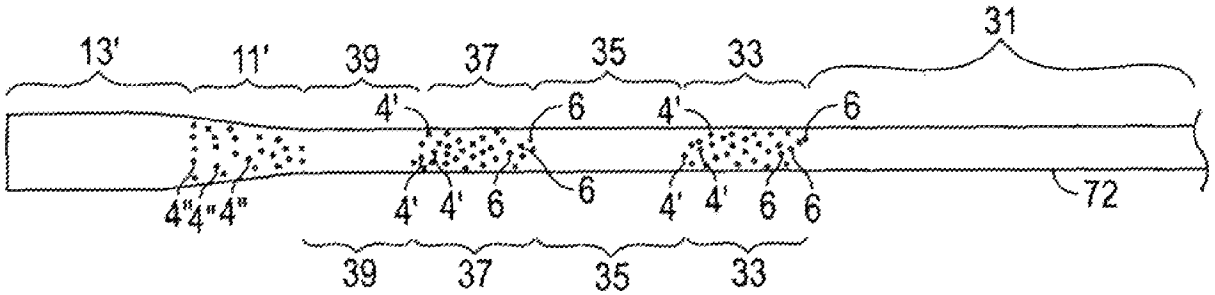
FIG. 2A is a cross sectional view taken along the long dimension of an another embodiment of a strand of the present disclosure, especially as is able to be manufactured according to teachings of FIG. 2.

The result is a strand 72 of the present disclosure shown in FIG. 2A having at least:

a) a first working load material portion 31 formed mainly of a first group of linear elements especially synthetic fibers having an elasticity of at least two and eight tenths percent;

b) a second material portion 35 formed mainly of a second group of linear elements especially synthetic fibers having an elasticity of lesser than two and eight tenths percent, and preferably having a lower creep value than a creep value of the linear elements from the first group of linear elements; and c) a first transition portion 33 formed mainly of linear elements of both the first and second group of linear elements mentioned in (a) and (b) immediately above, where first transition portion 33 includes:

(i) a plurality of severed ends 6 where such severed ends belong to the linear elements from the first group of linear elements, as well as;

(ii) a plurality of connections 4', each of which are the connection of a linear element of the first group of linear elements with a linear element of the second group of linear elements, where the second material portion 35 is used to form at least one strength member second material portion 35' of the present disclosure that is a portion of the strength member of the present disclosure capable of being deployed in contact with a block (including sheave) during use of the strength member for a period of time exceeding one half hour and possibly, but not necessarily up to several years, while concurrently increasing the life expectancy of that portion of the strength member of the present disclosure capable of being deployed in contact with a block (including sheave). Strength members of the present disclosure may, but are not required, to have several such second material portions 35'

Additionally, the strand 72 preferably includes a second transition portion 37 formed mainly of linear elements of both the first and second group of linear elements mentioned in (a) and (b) immediately above, where second transition portion 37 includes:

(i) a plurality of severed ends 6 where such severed ends belong to the linear elements from the second group of linear elements, as well as;

(ii) a plurality of connections 4', each of which are the connection of a linear element of the first group of linear elements with a linear element of the second group of linear elements (and that preferably include at least one knot).

Furthermore, next in sequence along the long dimension of the at least one strand 72, as shown in FIG. 2A, preferably, but not mandatorily, is a second working load material portion 39 formed mainly of at least some of a first group of linear elements that are preferably and especially synthetic fibers having an elasticity of at least two and eight tenths percent.

Additionally, when combined with the teachings taught in reference to FIG. 1, the strand 72 preferably, but not necessarily, includes an enlarged diameter portion 13' as well as a tapered diameter portion 11', where tapered diameter portion 11' includes a plurality of connections 4", each of which are the connection of a linear element of the first group of linear elements with a linear element of another group of linear elements having a material type that is similar (similar herein including "same") as a material type forming the linear elements of the first group of linear elements.

The density of connections 4, 4' and 4" is greater in the transition portions 11, 111, 33, 37 and 11' than is the density of other types of connections of linear elements in other portions of the strands of the present disclosure. Similarly, the density of severed ends 6 in transition portions 33 and 37, as well as the density of severed ends 61 in tapered transition portion 111 is greater than a density of other severed ends in other portions of the strands of the present disclosure, should such other severed ends be present, and such other severed ends are not necessarily present. In all cases, all and at least the majority of the connections 4, 4' and 4" preferably include at least one knot.

In reference to FIG. 4, when multiple of strands 72 are combined to form a braided strength member with synchronization of the various portions of several of distinct strands 72 as taught above in reference to forming strength members from strands 7, the resulting strength member of the present disclosure has at least one first working load material portion 9*a*; at least one strength member second material portion 35'; and at least one first strength member transition portion 33' containing a density of both connections 4 and/or 4' and/or 4" that preferably mainly include at least one knot per connection as well as containing a density of severed ends 6, 61. The strength member may, but not necessarily does, also include at least one second strength member transition portion 37' having similar properties in respect to connections 4, 4' and 4" and severed ends 6, 61 as the at least one first strength member transition portion 33'. The strength member may, but not necessarily does, also include at least one second strength member working load portion 39' (not shown). In such embodiments, the density of such connections 4, 4' and 4" and such severed ends 6, 61 in such at least one first strength member transition portion 33' is greater than a density of either or both such connections or such severed ends in the majority of other portions of portions of the strength member that are not transition portions.

The strength member may also contain at least some strands 72 having enlarged strand diameter portion 13' of each of the distinct strands 72 that are used to form a portion of a strength member of the present disclosure that is used to form a splice braid zone in the strength member of the present disclosure and especially a spliced eye in the strength member of the present disclosure.

Diameter Reduction Embodiments:

In some embodiments it may be desired to have an increased diameter zone of the strength member located at both terminal ends of the strength member. In such instances, two ended increased diameter zone strands of the present disclosure (not shown) are formed merely by first forming a strand 7 using the teachings taught in reference to FIG. 1 and otherwise herein for forming such strand 7, and subsequently reversing the process, including severing a desired number of strands entering the stranding point, one by one, over a predetermined length of the intended length of the strand so as to form severed linear element ends within a reverse tapered region of such strand.

Figure 3:
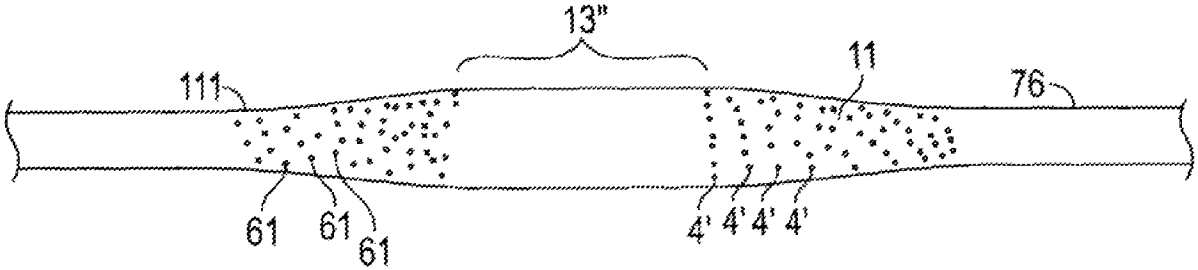
FIG. 3 is a cross sectional view taken along the long dimension of an another embodiment of a strand of the present disclosure, especially as is able to be manufactured according to combined teachings of FIG. 1 and FIG. 2.

Or, it may be desired to have an increased diameter zone of the strength member located between terminal ends of the strength member, such as in a region corresponding to a portion of the strength member intended to pass over and exit from a winch, block or other sheave (cumulatively known herein as "sheave"), In such embodiments of present disclosure, after forming the enlarged diameter portion of strands to be used in forming the strength members, the strands are reduced in diameter by essentially reversing the process used to increase them in diameter, or more specifically by gradually severing and thus removing fibers entering the stranding point until a desired reduced diameter is obtained for each such strand, resulting in strand 76 as shown in FIG. 3, Strand 76 includes an enlarged diameter portion 13", a positive tapered portion 11 including connections 4' and a reverse tapered portion 111 having first linear element severed ends and/or linear element severed ends 61, Then, should it be desired to have additional enlarged diameter portions in the final strength member for the purpose of forming extra strong spliced eyes, the teachings of the present disclosure in reference to FIG. 1 may be repeated so as to once again increase the quantity of fibers and thus the diameter of strands being formed by the process of the present disclosure resulting in a strand having enlarged diameter portions located at least at one distal end and possibly at both distal ends of such strands, as well as located at a region located between the strand's distal ends, thus permitting a correlating strength member construction using methods taught herein for synchronizing the strands various portions during construction of a braided strength member.

Example

1) A rope for use as a towing warp, the rope formed by a process characterized by steps of:

a) introducing at least some linear elements from at least a second group of linear elements (2) into a stranding process forming at least one strand (7) from at least a first group of linear elements (1);

b) subsequently using at least some of the strands (7) formed by such stranding process to form a braided strength member (21) that varies in at least one property in at least one region situated along its long dimension, whereby the strength member (21) exhibits at least one bettered characteristic being selected from a group of characteristics including: at least bettered durability; and at least bettered longevity.

2) The rope formed by the process of example 1 wherein the process further comprises an additional step of retaining in the stranding process at least some linear elements from the first group of linear elements (1) being used in the stranding process so as to increase in at least one first predetermined strand enlargement region (13) the quantity of linear elements (1, 2) forming the strand (7) and thus increase in said at least one first predetermined strand enlargement region (13) a diameter of the at least one strand (7) being formed by the stranding process and consequently increase in at least one predetermined strength member enlargement region (13*a*) along the long dimension of the strength member (21) a diameter of the strength member (21) formed by the at least some strands (7).

3) The rope formed by the process of example 2 wherein after steps of increasing in the at least one first predetermined strand enlargement region (13) the quantity of linear elements (1, 2) forming the at least one strand (7) and thus increasing in said at least one first predetermined strand enlargement region (13) the diameter of the at least one strand (7) being formed by the stranding process, the process further comprises additional steps of eliminating at least some linear elements (1, 2) being used in the stranding process, thereby reducing the diameter of the at least one strand (7) being formed by the stranding process in at least one predetermined strand diameter tapering region (11) that is located in a different place along the long dimension of the at least one strand (7) than is located the portion of the at least one strand (7) having the increased diameter, thereby causing the formed strength member (21) to have at least two strength member tapered diameter portions (11*a*) located along its long dimension where such at least two strength member tapered diameter portions (11*a*) exhibit a lesser diameter in comparison to said at least one predetermined strength member enlargement region (13*a*) of the strength member.

4) The rope formed by the process of any one of examples 2 to 3 wherein the process further comprises additional steps of selecting at least one region along the long dimension of the strength member for the at least one predetermined strength member enlargement region (13*a*) where such region corresponds to a location of an intended splice braid zone.

5) The rope formed by the process of any one of examples 3 to 4 wherein the process further comprises an additional step of selecting for at least some of the eliminated linear elements (1, 2) at least some linear elements of the second group of linear elements (2).

6) The rope formed by the process of any one of examples 3 to 4 wherein the process further comprises an additional step of selecting for at some of the eliminated linear elements (1, 2) at least some linear elements of at least the first group of linear elements (1).

7) The rope formed by the process of example 1 wherein the process further comprises an additional step of eliminating from the stranding process at least some linear elements from at least the first group of linear elements so as to cause at least some linear elements entering the stranding point to be replaced from those of the first group of linear elements with those of the second group of linear elements, thus causing linear elements forming the strand to vary in at least one predetermined region along the long dimension of the strand and to change from linear elements of at least the first group of linear elements to linear elements of at least the second group of linear elements and thus cause the strength member formed by a plurality of the strands to change in at least a first predetermined region along the strength member's long dimension from being formed mainly of linear elements of the first group of linear elements to being formed mainly of linear elements of the second group of linear elements.

8) The rope formed by the process of example 3 wherein after the steps of eliminating at least some linear elements (1, 2) being used in the stranding process, thereby reducing the diameter of the strand (7) being formed by the stranding process at a predetermined region that is located in a different place along the long dimension of the strand (7) than is located the said at least one first predetermined strand enlargement region (13), the process further comprises an additional step of eliminating from the stranding process at least some linear elements from at least the first group of linear elements (1) so as to cause at least some linear elements entering the stranding point to be replaced from those of the first group of linear elements (1) with at least some linear elements from the second group of linear elements (2), thus causing linear elements forming the strand (7, 72) to vary in a predetermined region (35) along the long dimension of the strand (7, 72) and to change from being mainly including linear elements of the first group of linear elements (1) to mainly including linear elements of the second group of linear elements (2), thus forming in at least one strand (72) at least a second material portion (35) and thus causing the strength member (21) formed by a plurality of the strands (7, 72) to be formed mainly of linear elements of the second group of linear elements (2) at a predetermined region (35') of the strength member and to have the increased diameter in a second predetermined region.

9) The rope formed by the process of any one of examples 7 or 8 wherein the process further comprises an additional step of selecting at least one region along the long dimension of the strength member for the at least a first predetermined region along the strength member's long dimension that is a region corresponding to at least a portion of the strength member that is intended to be disposed proximal a sheave during towing of an object with the tow warp.

10) The rope formed by the process of any one of examples 3 to 9 wherein the process further comprises an additional step of causing the elimination of linear elements (1, 2) to be a gradual elimination of the linear elements.

11) The rope formed by the process of any one of examples 7 to 10 wherein after the step of eliminating from the stranding process at least some linear elements from at least the first group of linear elements so as to cause at least some linear elements entering the stranding point to be replaced from those of the first group of linear elements (1) with those of the second group of linear elements (2) the process further comprises steps of reversing the process thereby replacing at least some linear elements from the second group of linear elements (2) by at least some linear elements linear elements having a material same as the material mainly forming linear elements from first group of linear elements (1).

12) The rope formed by the process of any one of examples 1 to 11 wherein the process further comprises steps of selecting a material for the second group of linear elements (2) that is a same material as a material forming the first group of linear elements (1).

13) The rope formed by the process of any one of examples 1 to 11 wherein the process further comprises steps of selecting a material for the second group of linear elements (2) that is a different material than a material forming the first group of linear elements (1).

14) The rope formed by the process of any one of examples 1 to 11 wherein the process further comprises steps of selecting a material for the second group of linear elements (2) that is a different material than a material forming the first group of linear elements (1) and wherein linear elements from the second group of linear elements (2) have lesser creep than do linear elements from the first group of linear elements (1).

15) The rope formed by the process of any one of examples 1 to 11 wherein the process further comprises steps of selecting a material for the second group of linear elements (2) that is a different material than a material forming the first group of linear elements (1) and wherein linear elements from the second group of linear elements (2) have a different melting point than do linear elements from the first group of linear elements (1).

16) The rope formed by the process of any one of examples 1 to 11 wherein the process further comprises steps of selecting a material for the second group of linear elements (2) that is a different material than a material forming the first group of linear elements (1) and wherein linear elements from the second group of linear elements (2) have higher melting point than do linear elements from the first group of linear elements (1).

17) The rope formed by the process of example 9 wherein the process further comprises steps of selecting a material for the second group of linear elements (2) that is a different material than a material forming the first group of linear elements (1) and wherein linear elements from the second group of linear elements (2) have lesser elasticity than do linear elements from the first group of linear elements (1).

18) The rope formed by the process of example 17 wherein the process further comprises steps of selecting a material for the second group of linear elements (2) that is a different material than a material forming the first group of linear elements (1), wherein linear elements from the second group of linear elements (2) have lesser elasticity than do linear elements from the first group of linear elements (1), and wherein linear elements from the second group of linear elements (2) have an elasticity that is lesser than two and eight tenths percent.

19) The rope formed by the process of any one of examples 9, 17 or 18 wherein the process is further characterized by additional steps of selecting to form the at least one first predetermined region from a second material portion (35, 35') that corresponds to a portion of the strength member (21) that is a portion of the strength member (21) capable of being deployed in contact with a block during use of the strength member (21) for a period of time exceeding one half hour while concurrently increasing the life expectancy of that portion of the strength member (21) of the present disclosure capable of being deployed in contact with a block.

20) The rope formed by the process of example 20 wherein the process is further characterized by additional steps of forming connections (4, 4', 4") between linear elements (1, 2) forming strands forming the strength member wherein a density of connections (4, 4', 4") is greater in at least a portion of the strength member proximal the second material portion (35') than it is in the majority of remaining portions of the strength member.

21) The rope formed by the process of example 20 wherein the process is further characterized by additional steps of forming severed ends (6, 61) of linear elements forming at least some strands forming the strength member wherein a density of severed ends (6, 61) is greater in at least a portion of the strength member proximal the second material portion (35') than it is in the majority of remaining portions of the strength member.

22) The rope formed by the process of any of examples 1 to 21 wherein at least some linear elements from the first group of linear elements (1) are connected to at least some linear elements from the second group of linear elements (2) by means of at least one knot (4, 4', 4").

23) A rope for use as towing warp, the rope having a strength member (21) formed of strands (7, 7*b*. 72) and formed with a braided construction, the rope comprising at least one region of the strength member mainly formed of at least a first group of linear elements (1) that are mainly formed of a substance that is a substance that exhibits differing properties than a substance mainly forming other linear elements (2) mainly forming at least one other region of the strength member.

24) A rope for use as towing warp, the rope having a strength member (21) formed of strands (7, 7*b*, 72) and formed with a braided construction, the rope comprising:

a) at least one region of the strength member mainly formed of at least a first group of linear elements (1) and defining a working load diameter portion (9*a*) of the strength member;

b) at least one other region of the strength member (21), that is a strength member tapered diameter portion (11*a*) that mainly is formed of a combination of at least some of a first group of linear elements (1) and at least some of a second group of linear elements (2); and c) at least one strength member enlarged diameter portion (13*a*) that mainly is formed of at least some linear elements from both the first and second group of linear elements (1, 2).

25) The rope for use as towing warp of example 24, the rope having a strength member (21) formed of strands (7, 7*b*, 72) and formed with a braided construction, the rope comprising:

a) at least one region of the strength member mainly formed of at least a first group of linear elements (1) and defining a working load diameter portion (9*a*) of the strength member;

b) at least one other region of the strength member (21), that is a strength member tapered diameter portion (11*a*) that mainly is formed of a combination of at least some of a first group of linear elements (1) and at least some of a second group of linear elements (2);

c) at least one strength member enlarged diameter portion (13*a*) that mainly is formed of at least some linear elements from both the first and second group of linear elements (1, 2); and d) at least one first predetermined region of the strength member formed from a second material portion (35') that corresponds to a portion of the strength member (21) that is a portion of the strength member (21) capable of being deployed in contact with a block during use of the strength member (21) for a period of time exceeding half an hour while concurrently increasing the life expectancy of that portion of the strength member (21) of the present disclosure capable of being deployed in contact with a block.

26) The rope for use as towing warp of example 23, the rope having a strength member (21) formed with a braided construction, the rope comprising:

a) at least one region of the strength member mainly formed of at least a first group of linear elements (1) and defining a working load diameter portion (9*a*) of the strength member;

b) at least one region of at least some strands (7, 7*b*, 72), that is at least one strand first transition portion (33) that mainly is formed of a combination of at least some of a first group of linear elements (1) and at least some of a second group of linear elements (2); and c) at least one first predetermined region of the strength member formed from a second material portion (35') that corresponds to a portion of the strength member (21) that is a portion of the strength member (21) capable of being deployed in contact with a block during use of the strength member (21) for a period of time exceeding half an hour while concurrently increasing the life expectancy of that portion of the strength member (21) of the present disclosure capable of being deployed in contact with a block.

27) The rope for use as a towing warp of example 26 wherein the rope further comprises at least one strength member (21) having at least one strand (7, 7*b*, 72) wherein the strand includes at least one second strand transition portion (37).

28) The rope for use as towing warp of example 26, the rope having a strength member (21) formed with a braided construction, the rope comprising:

a) at least a region of the strength member mainly formed of at least a first group of linear elements (1) and defining a working load diameter portion (9*a*) of the strength member;

b) at least one region of the strength member that is at least one strength member first transition portion (33') that mainly is formed of a combination of at least some of a first group of linear elements (1) and at least some of a second group of linear elements (2); and c) at least one first predetermined region of the strength member formed from a second material portion (35') that corresponds to a portion of the strength member (21) that is a portion of the strength member (21) capable of being deployed in contact with a block during use of the strength member (21) for a period of time exceeding half an hour while concurrently increasing the life expectancy of that portion of the strength member (21) of the present disclosure capable of being deployed in contact with a block.

29) The rope for use as a towing warp of example 28 wherein the rope further comprises at least one second strength member transition portion (37').

INDUSTRIAL APPLICABILITY

A preferred construction for the braided strength member of the present disclosure is a hollow braided pre-heat stretched strength member having a supportively configured core. A pre heat stretching process for compacting the final produced strength member of the present disclosure, including with a supportive core, is highly preferred for some applications such as trawling, but is not always desired for other applications. A preferred process for producing such a pre-heat stretched strength member with a supportive core, as well as a preferred process for producing a protective cover, or sheath, about such strength member and a preferred process for forming spliced eyes into such strength member whenever it is possible to pre-form a spliced eye prior to delivery of the tow warp of the present disclosure to an end user, are taught in an attached copy of co-pending International Patent Application No. PCT/IS2010/000012, titled: Synthetic rope for powered blocks and methods for production, consisting of forty-seven sheets and that is hereby incorporated in entirety.

The tow warp of the present disclosure also may be used as an anchor line, or a mooring line, a crane line, or a mooring line for deep water oil derricks where the portion of the strength member that corresponds to a block and/or sheave is so used and where the portion of the strength member that is intended for forming a spliced eye is also so used, as well as any other useful application for ropes used with blocks and/or used to connect to objects where such ropes and/or objects are subject to fluid flow and especially to moving water.

Without departing from the spirit and scope of the disclosure, various alterations, modifications, and/or alternative applications of the disclosure appear likely to be suggested to those skilled in the art after having read the preceding disclosure. Accordingly, it is intended that the following claims be interpreted as encompassing all alterations, modifications, or alternative applications as fall within the true spirit and scope of the disclosure.

What is claimed is:

1. A rope formed by a process characterized by steps of:

a) progressively introducing fibers from at least a second group of fibers (2) into a stranding process where fibers from a first group of fibers are being stranded to form at least one strand (7) from at least a first group of fibers (1) so as to form several distinct strands (7) that each varies in at least one property in at least one region situated along its long dimension, so as to either or both increase the diameter of the strands and/or substitute the first group of fibers by fibers from the second group of fibers; and b) subsequently using at least some of the strands (7) formed by such stranding process to form with a braiding machine a braided strength member (21) that varies in at least one property in at least one region situated along its long dimension.

2. The rope of claim 1 wherein the process further comprises an additional step of retaining in the stranding process at least some fibers from the first group of fibers (1) being used in the stranding process so as to increase in at least one first predetermined strand enlargement region (13) the quantity of fibers (1, 2) forming the strand (7) and thus increase in said at least one first predetermined strand enlargement region (13) a diameter of the at least one strand (7) being formed by the stranding process and consequently increase in at least one predetermined strength member enlargement region (13*a*) along the long dimension of the strength member (21) a diameter of the strength member (21) formed by the at least some strands (7).

3. The rope of claim 2 wherein after steps of increasing in the at least one first predetermined strand enlargement region (13) the quantity of fibers (1, 2) forming the at least one strand (7) and thus increasing in said at least one first predetermined strand enlargement region (13) the diameter of the at least one strand (7) being formed by the stranding process, the process further comprises additional steps of eliminating at least some fibers (1, 2) being used in the stranding process, thereby reducing the diameter of the at least one strand (7) being formed by the stranding process in at least one predetermined strand diameter tapering region (11) that is located in a different place along the long dimension of the at least one strand (7) than is located the portion of the at least one strand (7) having the increased diameter, thereby causing the formed strength member (21) to have at least two strength member tapered diameter portions (11*a*) located along its long dimension where such at least two strength member tapered diameter portions (11*a*) exhibit a lesser diameter in comparison to said at least one predetermined strength member enlargement region (13*a*) of the strength member.

4. The rope of claim 2 wherein the process further comprises additional steps of selecting at least one region along the long dimension of the strength member for the at least one predetermined strength member enlargement region (13*a*) where such region corresponds to a location of an intended splice braid zone.

5. The rope of claim 3 wherein the process further comprises an additional step of selecting for at least some of the eliminated fibers (1, 2) at least some fibers of the second group fibers (2).

6. The rope of claim 3 wherein the process further comprises an additional step of selecting for at some of the eliminated fibers (1, 2) at least some fibers of at least the first group of fibers (1).

7. The rope of claim 1 wherein the process further comprises an additional step of eliminating from the stranding process at least some fibers from at least the first group of fibers so as to cause at least some fibers entering the stranding point to be replaced from those of the first group of fibers with those of the second group of fibers, thus causing fibers forming the strand to vary in at least one predetermined region along the long dimension of the strand and to change from fibers of at least the first group of fibers to fibers of at least the second group of fibers and thus cause the strength member formed by a plurality of the strands to change in at least a first predetermined region along the strength member's long dimension from being formed mainly of fibers of the first group of fibers to being formed mainly of fibers of the second group of fibers.

8. The rope of claim 3 wherein after the steps of eliminating at least some fibers (1, 2) being used in the stranding process, thereby reducing the diameter of the strand (7) being formed by the stranding process at a predetermined region that is located in a different place along the long dimension of the strand (7) than is located the said at least one first predetermined strand enlargement region (13), the process further comprises an additional step of eliminating from the stranding process at least some fibers from at least the first group of fibers (1) so as to cause at least some fibers entering the stranding point to be replaced from those of the first group of fibers (1) with at least some fibers from the second group of fibers (2), thus causing fibers forming the strand (7, 72) to vary in a predetermined region (35) along the long dimension of the strand (7, 72) and to change from being mainly including fibers of the first group of fibers (1) to mainly including fibers of the second group of fibers (2), thus forming in at least one strand (72) at least a second material portion (35) and thus causing the strength member (21) formed by a plurality of the strands (7, 72) to be formed mainly of fibers of the second group of fibers (2) at a predetermined region (35') of the strength member and to have the increased diameter in a second predetermined region.

9. The rope of claim 8 wherein the process further comprises an additional step of selecting at least one region along the long dimension of the strength member for the at least a first predetermined region along the strength member's long dimension that is a region corresponding to at least a portion of the strength member that is intended to be disposed proximal a sheave during towing of an object with the rope.

10. The rope of claim 3 wherein the process further comprises an additional step of causing the elimination of fibers (1, 2) to be a gradual elimination of the fibers.

11. The rope of claim 7 wherein after the step of eliminating from the stranding process at least some fibers from at least the first group of fibers so as to cause at least some fibers entering the stranding point to be replaced from those of the first group of fibers (1) with those of the second group of fibers (2) the process further comprises steps of reversing the process thereby replacing at least some fibers from the second group of fibers (2) by at least some fibers having a material same as the material mainly forming fibers from first group of fibers (1).

12. The rope of claim 1 wherein the process further comprises steps of selecting a material for the second group of fibers (2) that is a different material than a material forming the first group of fibers (1) and wherein fibers from the second group of fibers (2) have lesser creep than do fibers from the first group of fibers (1).

13. The rope of claim 1 wherein the process further comprises steps of selecting a material for the second group of fibers (2) that is a different material than a material forming the first group of fibers (1) and wherein fibers from the second group of fibers (2) have a different melting point than do fibers from the first group of fibers (1).

14. The rope of claim 1 wherein the process further comprises steps of selecting a material for the second group of fibers (2) that is a different material than a material forming the first group of fibers (1) and wherein fibers from the second group of fibers (2) have higher melting point than do fibers from the first group of fibers (1).

15. The rope of claim 9 wherein the process further comprises steps of selecting a material for the second group of fibers (2) that is a different material than a material forming the first group of fibers (1) and wherein fibers from the second group of fibers (2) have lesser elasticity than do fibers from the first group of fibers (1).

16. The rope of claim 13 wherein the process further comprises steps of selecting a material for the second group of fibers (2) that is a different material than a material forming the first group of fibers (1), wherein fibers from the second group of fibers (2) have lesser elasticity than do fibers from the first group of fibers (1), and wherein fibers from the second group of fibers (2) have an elasticity that is lesser than two and eight tenths percent.

17. The rope of claim 1 wherein the process is further characterized by additional steps of forming connections (4, 4', 4") between fibers (1, 2) forming strands forming the strength member wherein a density of connections (4, 4', 4") is greater in at least a portion of the strength member proximal strength member portion (35') than it is in the majority of remaining portions of the strength member.

18. The rope of claim 1 wherein the process is further characterized by additional steps of forming severed ends (6, 61) of fibers forming at least some strands forming the strength member wherein a density of severed ends (6, 61) is greater in at least a portion of the strength member proximal strength member portion (35') than it is in the majority of remaining portions of the strength member.

19. The rope of claim 1 wherein at least some fibers from the first group of fibers (1) are connected to at least some fibers from the second group of fibers (2) by means of at least one knot (4, 4', 4").

20. The rope of claim 7 wherein the process further comprises an additional step of causing the elimination of fibers (1, 2) to be a progressive elimination of the fibers.

21. The rope of claim 8 wherein the process further comprises an additional step of causing the elimination of fibers (1, 2) to be a progressive elimination of the fibers.

* * * * *